United States Patent [19]

Morgan et al.

[11] Patent Number: 4,945,750

[45] **Date of Patent: * Aug. 7, 1990**

[54] PRESS FORGING OF MOLYBDENUM OR MOLYBDENUM ALLOY PARTS

[75] Inventors: Ricky D. Morgan, Ulster; Vito P. Sylvester, Athens, both of Pa.

[73] Assignee: GTE Products Corporation, Stamford, Conn.

[ * ] Notice: The portion of the term of this patent subsequent to Apr. 18, 2006 has been disclaimed.

[21] Appl. No.: 227,566

[22] Filed: Aug. 3, 1988

Related U.S. Application Data

[63] Continuation-in-part of Ser. No. 9,433, Feb. 2, 1987, Pat. No. 4,821,554.

[51] Int. Cl.[5] ..... B21J 1/02

[52] U.S. Cl. ..... 72/377; 72/700

[58] Field of Search ..... 72/700, 341, 343, 377

[56] References Cited

U.S. PATENT DOCUMENTS 2,921,875 1/1960 Schnitzel et al. ..... 72/700
3,035,341 5/1962 Frank et al. ..... 72/700

FOREIGN PATENT DOCUMENTS 688255 9/1979 U.S.S.R. ..... 72/700

OTHER PUBLICATIONS

Forging Equipment Materials, and Practices Altan et al., 10/1973, p. 173.

*Primary Examiner*—David Jones
*Attorney, Agent, or Firm*—Donald R. Castle

[57] ABSTRACT

A method is disclosed for deforming a molybdenum based metal part, which involves press forging a powder metallurgically produced part made of material selected from the group consisting of molybdenum metal and molybdenum metal alloys, at a temperature of from about 1700° F. to about 2300° F. at an average strain rate of from about 5 inches per minute to about 20 inches per minute.

3 Claims, No Drawings

PRESS FORGING OF MOLYBDENUM OR MOLYBDENUM ALLOY PARTS

This application is a continuation-in-part of application Ser. No. 009,433, filed Feb. 2, 1987 now U.S. Pat. No. 4,821,554 and entitled "Press Forging of Molybdenum Or Molybdenum Alloy Parts".

This invention relates to a method for deforming a molybdenum based metal part by press forging the part in one step at a particular temperature and strain rate combination.

BACKGROUND OF THE INVENTION

Molybdenum and molybdenum alloys are deformed typically by hammer forging or press forging in more than one step.

Hammer forging involves the use of frequent blows to the material much in the same manner as a blacksmith forming a horseshoe with an anvil and hammer. The impact or transfer of force from the dies to the material occurs very rapidly resulting in unknown strain rates on the material. This happens every instance that the rams attempt to come together. It takes numerous blows to achieve the desired amount of deformation or, more particularly, reduction in height of the part. Under normal conditions, this occurs in a five to ten minutes time period, but it is a one-step process (no cooling down and reheating, etc.) This method of deforming is very costly and the strain rate cannot be controlled. As a result there is a chance of the resulting deformed parts having defects.

Press forging is a type of deformation which up to this time has required many heating and cooling steps. In press forging, a constantly increasing pressure is applied to the material. The part is squeezed between one hydraulically powered ram and a stationary ram, both of which have dies attached to them. Since the rate of increase (speed at which the rams are brought closer to one another) can be controlled, the strain rate on the material can be specified. The plurality of steps in press forging makes the process time consuming.

U.S. Pat. No. 3,035,341 relates to making an arc cast molybdenum alloy rod, plate, or bar. This process is a multi-step operation using upsetting, block forging, finish forging and hot drop forging. Even when parts are small, only the upsetting operation is omitted.

SUMMARY OF THE INVENTION

In accordance with one aspect of this invention, there is provided a method for deforming a molybdenum based metal part, which involves press forging a powder metallurgically produced part made of material selected from the group consisting of molybdenum metal and molybdenum metal alloys, at a temperature of from about 1700° F. to about 2300° F. at an average strain rate of from about 5 inches per minute to about 20 inches per minute.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

This invention relates to a method for deforming molybdenum or molybdenum alloy parts by a one step operation involving the use of a specific temperature and strain rate combination.

The starting part can be a press and sintered billet, a hot isostatically pressed billet, or a recrystallized billet. The part is powder metallurgically produced.

The part is made of molybdenum metal or molybdenum metal alloys.

The press forging equipment that is used is any press that can develop the pressures to deform the part within the given strain rates.

The temperature and the strain rate are critical to the success of the one-step press forging operation.

The temperatures are from about 1700° F. to about 2300° F. with from about 2000° F. to about 2200° F. being the preferred range.

The strain rate which is in actuality the average strain rate is defined as the change in height in the part with time. The average strain rates used in the practice of this invention in the above given temperature range are from about 5 inches per minute to about 20 inches per minute with from about 8 inches per minute to about 14 inches per minute being preferred. It is critical that the strain rate be kept within the above values. Strain rates higher than the above values can possibly result in the part heating up and recrystallizing or cracking. Strain rates slower than the above values will not allow the part to be deformed in one step.

Friction causes rises in temperature in the system. It is critical that the temperature be controlled to maintain the properties of the part. Therefore, care must be taken to reduce friction so that the temperature is maintained within the critical ranges of this invention. Some methods of reducing friction are to use forging papers, glass lubricants, or canning.

To more fully illustrate this invention, the following non-limiting example is presented.

EXAMPLE

A molybdeum alloy part having a diameter of about 15¼" and a height of about 14⅜" and weighing about 925 pounds is pressed in a standard forging press at a temperature of about 2200° F. and an average strain rate of about 10 inches per minute at from about 9000 to about 15,000 tons of total force, to a height of about 5.5" and a diameter of about 24". The resulting press forged part can be easily machined to a desired size.

While there has been shown and described what are at present considered the preferred embodiments of the invention, it will be obvious to those skilled in the art that various changes and modifications may be made therein without departing from the scope of the invention as defined by the appended claims.

What is claimed is:

1. A method for deforming a molybdenum based part from a billet to a press forged part for subsequent machining, said method consisting essentially of press forming a powder metallurgically produced part made of a material selected from the group consisting of molybdenum metal and molybdenum metal alloys, at a temperature of from about 1700° F. to about 2300° F. at an average strain rate of from about 5 inches per minute to about 20 inches per minute, said press forging being done in one step.

2. A method of claim 1 wherein said temperature is from about 2000° F. to about 2200° F.

3. A method of claim 1 wherein said strain rate is from about 8 inches per minute to about 14 inches per minute.

* * * * *